US006821354B2

(12) United States Patent
McKee

(10) Patent No.: US 6,821,354 B2
(45) Date of Patent: Nov. 23, 2004

(54) HYPERWASH DISHWASHER

(75) Inventor: Philip McKee, Frisco, TX (US)

(73) Assignee: Praxis Technology Group, Inc., Dallas, TX (US)

( * ) Notice: Subject to any disclaimer, the term of this patent is extended or adjusted under 35 U.S.C. 154(b) by 112 days.

(21) Appl. No.: 10/382,424

(22) Filed: Mar. 6, 2003

(65) Prior Publication Data

US 2004/0040580 A1 Mar. 4, 2004

Related U.S. Application Data

(63) Continuation of application No. 09/733,169, filed on Dec. 8, 2000, now Pat. No. 6,550,488.

(51) Int. Cl.[7] ..... B08B 7/04

(52) U.S. Cl. ..... 134/18; 134/19; 134/25.2; 134/56 D; 134/57 D; 134/58 D; 134/95.3; 134/113; 134/198

(58) Field of Search ..... 134/18, 25.2, 56 D, 134/57 D, 58 D, 95.3, 113

(56) References Cited

U.S. PATENT DOCUMENTS 4,135,531 A * 1/1979 Federighi et al. ..... 134/95.3
4,568,821 A * 2/1986 Boe ..... 219/419

* cited by examiner

*Primary Examiner*—Michael Barr
*Assistant Examiner*—Gentle E. Winter
(74) *Attorney, Agent, or Firm*—Amster, Rothstein & Ebenstein LLP

(57) ABSTRACT

An efficient residential dishwasher is disclosed. The residential dishwasher comprises a washing chamber, a rack within the washing chamber for holding dishes, a water tank for holding hot water to be used to clean dishes located on the rack, and at least one spray head within the washing chamber for cleaning dishes on the rack. After hot water has been delivered from the water tank to the washing chamber, the spray head sprays hot water to the dishes on the rack for the purpose of cleaning. The water tank will be filled with water from a fresh water line in response to a cooking apparatus being turned on.

13 Claims, 2 Drawing Sheets

HYPERWASH DISHWASHER

CROSS-REFERENCE TO RELATED APPLICATION

This is a continuation of U.S. patent application Ser. No. 09/733,169, filed Dec. 8, 2000, now U.S. Pat. No. 6,550,488.

BACKGROUND OF THE INVENTION

1. Technical Field

The present invention relates to dishwashers in general, and in particular to residential dishwashers. Still more particularly, the present invention relates to a residential dishwasher capable of cleaning dishes within a relatively short time period.

2. Description of the Prior Art

A dishwasher is typically the backbone of a home kitchen cleanup process. After loading dirty dishes in a dishwasher, a busy individual or family can proceed to attend to other matters while the dishwasher dutifully cleans the dirty dishes. Thus, no modern home would be complete without a dishwasher.

A residential dishwasher generally requires about 75 minutes to perform the entire dish-washing process, which commonly includes a 15-minute first wash cycle, a 7-minute first rinse cycle, a 7-minute second rinse cycle, a 15-minute second wash cycle, a 7-minute third rinse cycle, a 9-minute fourth rinse cycle, and a 15-minute dry cycle. During the roughly 75-minute dish-washing process, the dishwasher typically makes an agitating noise that inhibits the quiet enjoyment of a home. In addition, fresh tap water is typically drawn into the washing chamber in each of the above-mentioned cycles for washing and rinsing purposes; thus, an exorbitant amount of fresh tap water will be consumed by the dishwasher. During the dry cycle, dishes are generally dried by a resistive heating element, which is usually not very energy efficient. Be that as it may, the temperature inside the washing chanter is only high enough to wash and dry the dishes but not nearly high enough to sterilize them.

In summary, the prior art residential dishwasher is noisy, energy inefficient, wastes water, does not sanitize dishes, and definitely takes a long time to clean dishes. Consequently, it would be desirable to provide an improved residential dishwasher that overcomes the above-mentioned problems.

SUMMARY OF THE INVENTION

In accordance with a preferred embodiment of the present invention, a residential dishwasher comprises a washing chamber, a rack within the washing chamber for holding dishes, a water tank for holding hot water to be used to clean dishes located on the rack, and at least one spray head within the washing chamber for cleaning dishes on the rack. After hot water has been delivered from the water tank to the washing chamber, preferably via a pump, the spray head sprays hot water to the dishes on the rack for the purpose of cleaning. The water tank will be filled with water from a fresh water line in response to a cooking apparatus being turned on. The cooking apparatus can be a stove, a range, or an oven.

All objects, features, and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
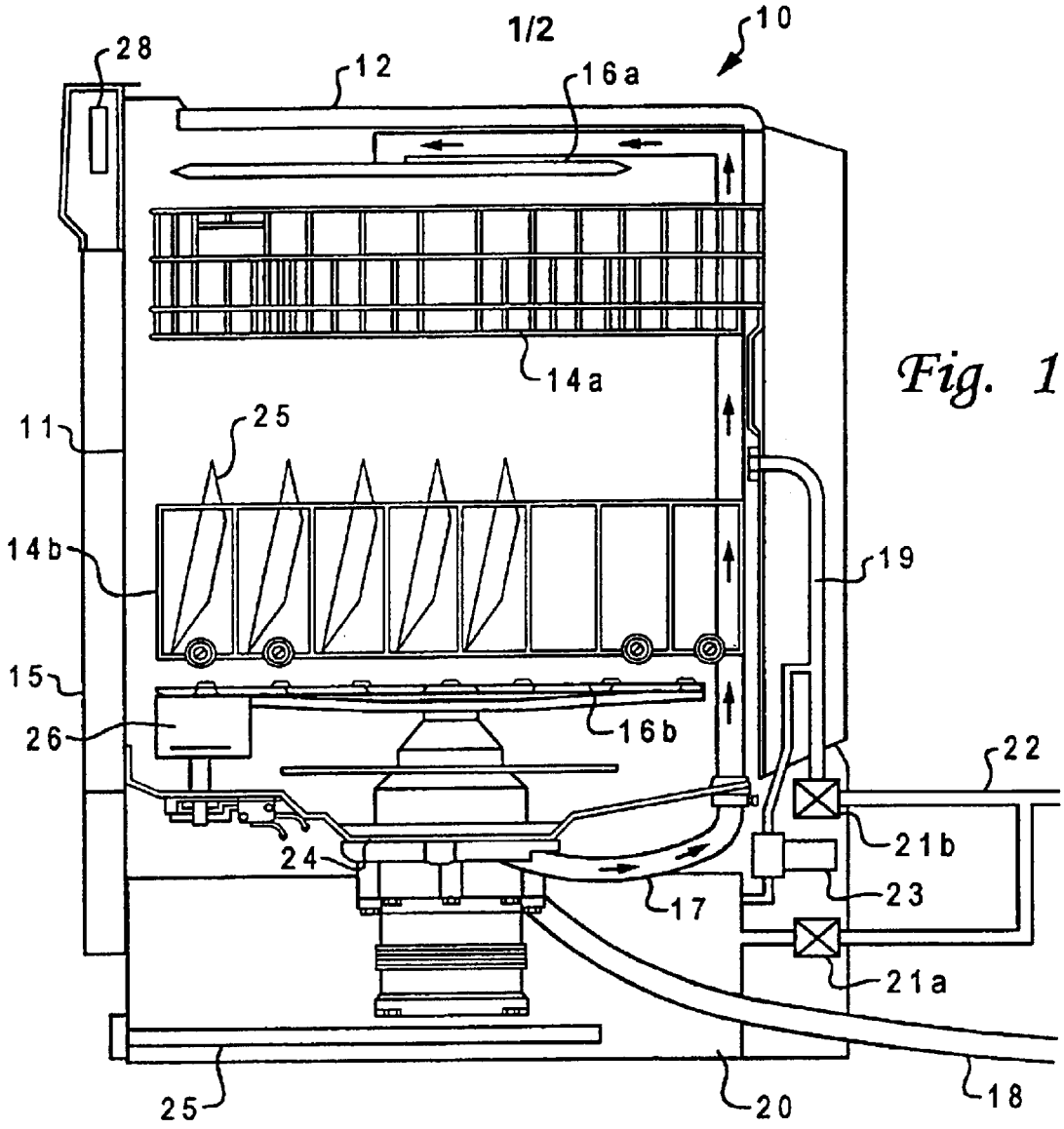
FIG. 1 is a pictorial diagram of a residential dishwasher in accordance with a preferred embodiment of the present invention.

Referring now to the drawings and in particular to FIG. 1, there is depicted a pictorial diagram of a residential dishwasher in accordance with a preferred embodiment of the present invention. As shown, a dishwasher 10 includes a washing chamber 11 provided within a casing 12. Inside washing chamber 11, racks 14*a*, 14*b* are provided for holding dishes. For example, dishes 25 are held by rack 14*b*. Dishwasher 10 operates at 110 V, which is a voltage commonly used by residential dishwashers. Furthermore, dishwasher 10 includes a door 15 located at the front-side of dishwasher 10. Such door-arrangement is commonly known as "front-loading,", which is a feature typically found in residential dishwashers and not in commercial dishwashers. A set of control logic circuits 28, such as processors, controllers, etc., can be positioned within the front panel of door 15 for receiving inputs from a user and for controlling various dishwashing operations as will be described supra.

As a preferred embodiment of the present invention, dishwasher 10 includes a water tank 20 preferably located at the bottom of dishwasher 10. Water tank 20 is preferably made of stainless steel, having reinforced joints and sidewalls that allow water tank 20 to withstand relatively high water pressure. The size of water tank 20 depends on the amount of water it needs to hold.

Water tank 20 can be filled with water from a fresh water tap through a water supply pipe 22. The amount of water in water tank 20 can be in the range of 3 to 6 gallons but is preferably in the range of 4 to 5 gallons. Although not necessary, the fresh water for filling water tank 20 can be hot water coming from a hot water line. The water in water tank 20 can be further heated by a heating element 25 located within water tank 20. Water from water supply pipe 22 enters water tank 20 when a valve 21*a* is opened, and/or enters washing chamber 11 when a valve 21*b* is opened.

The hot water stored in water tank 20 can be delivered to washing chamber 11 via a pump 23 and a line 19. A float 26 rises as hot water is being delivered to washing chamber 11, and float 26 will reach a maximum height when there is enough hot water in washing chamber 11; at which point, both pump 23 as well as value 21*b* will be shut off. Hot water within washing chamber 11 may be sent to a spray head 16*b* via a circulating pump 24, or to a spray head 16*a* via circulating pump 24 and a pipe 17, for dish cleaning purposes. After washing or rinsing has been completed, dirty water in washing chamber 11 is drained via a drain line 18. Although two racks and two spray heads are utilized in the present embodiment, it is understood by those skilled in the art that any number of racks and spray heads is acceptable for dishwasher 10.

Figure 2:
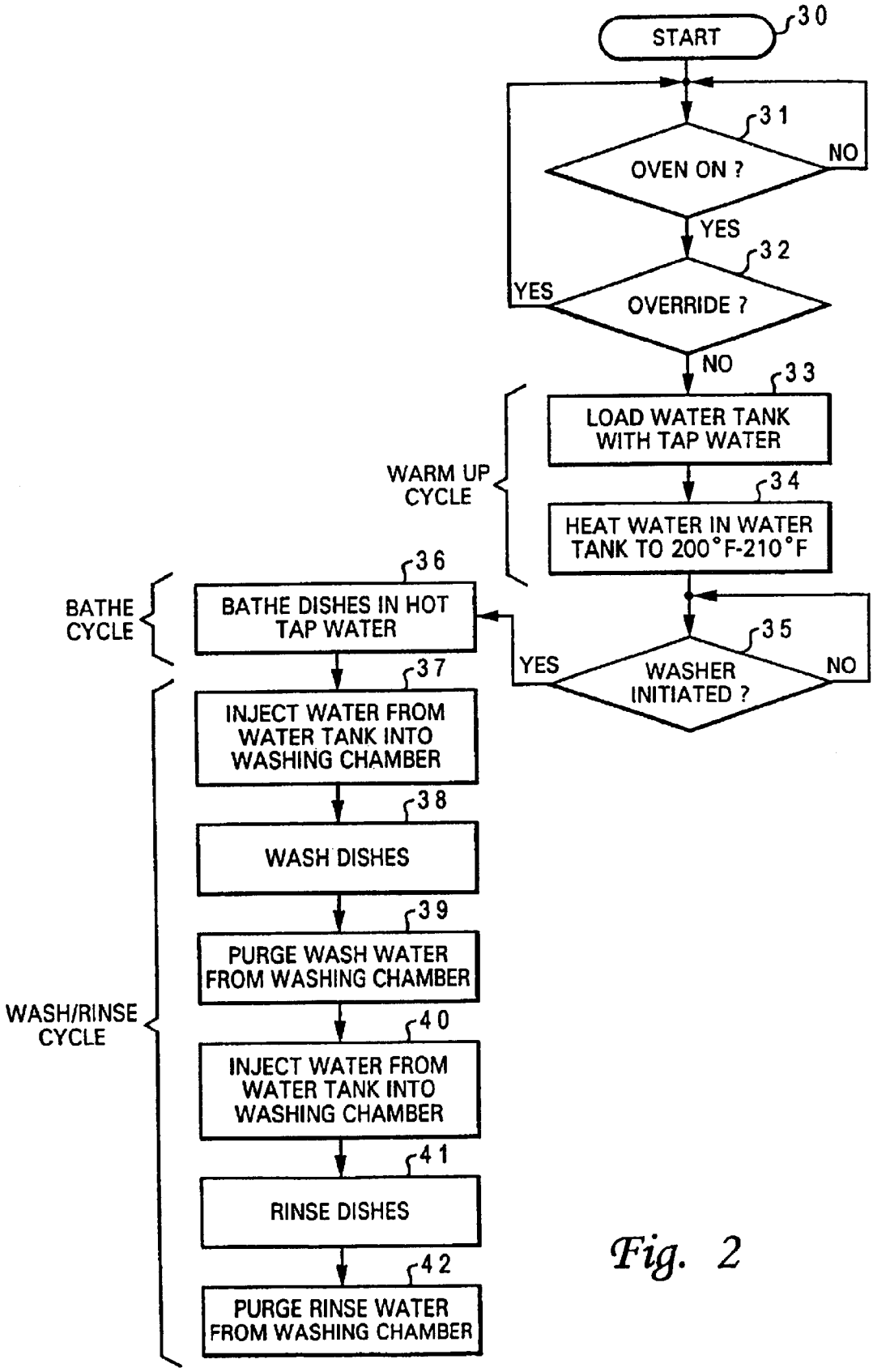
FIG. 2 is a high-level flow diagram of a method for controlling the dishwasher from FIG. 1, in accordance with a preferred embodiment of the present invention.

With reference now to FIG. 2, there is illustrated a high-level flow diagram of a method of controlling the operations of dishwasher 10, in accordance with a preferred embodiment of the present invention. Starting at block 30, dishwasher 10 detects whether or not an oven or a stove has been turned on, as shown in block 31. The detection will be further described infra. If the oven or stove has been turned on, a determination is made as to whether or not the process has been overridden, for example, by someone who decided dishwasher 10 is not required to be turned on at this time, as shown in block 32. If the process has been overridden, the process returns back to block 31. When a user, for whatever reasons, decided to stop dishwasher 10 from entering the warm-up cycle after the water tank has been filled with hot water, the water can be retained in the water tank for future use or can be drained if necessary.

If the process has not been overridden, dishwasher 10 enters a warm-up cycle in which tap water from a fresh water line enters water tank 20 (from FIG. 1), as depicted in block 33. Although not necessary, the water for filling water tank 20 is preferably hot water coming from a hot water line with water temperature in the range of 120° F.–140° F. Water tank 20 is then heated to a temperature of preferably 190° F.–210° F. by a heater, as illustrated in block 34. At this point, dishwasher 10 is ready to receive soiled or dirty dishes for the purpose of cleaning.

After soiled or dirty dishes have been loaded in dishwasher 10, a determination is made as to whether or not dish washing has been initiated, as shown in block 35. If dish washing has been initiated by a user, such as the pushing of a start button, dishwasher 10 enters a bathe cycle in which the soiled or dirty dishes in washing chamber are bathed with hot tap water having temperature preferably in the range of 120° F.–140° F., as depicted in block 36. The source of hot water for the bathe cycle car be solely from the above-mentioned hot water line or from both the above-mentioned hot water line and water tank 20. The temperature of washing chamber 11 is elevated during the bathe cycle.

Next, dishwasher 10 enters a wash/rinse cycle in which hot water from water tank 20 is forcefully injected into the washing chamber via pump 23 and line 19 (from FIG. 1), as shown in block 37. The temperature of the hot water from water tank 20 is preferably at least 190° F. The dishes are subsequently washed for approximately two minutes, as depicted in block 38. Afterwards, the wash water is purged from the washing chamber, as illustrated in block 39. Next, hot water from water tank 20 is again delivered into the washing chamber for rinsing purpose, as shown in block 40. The dishes are then rinsed for approximately two minutes, as shown in block 41. Afterwards, the rinse water is purged from the washing chamber, as depicted in block 42. At this point, the dishes are clean, and are ready to be unloaded from dishwasher 10. The clean dishes can be unloaded immediately because the high temperature water enables a "flash dries" from contact with the high-temperature dishes.

Figure 3:
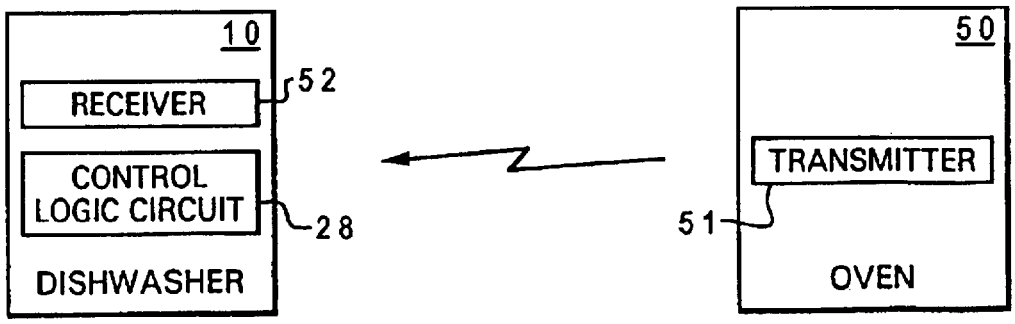
FIG. 3 is a block diagram of the apparatus for initiating operation of the dishwasher from FIG. 1, in accordance with a preferred embodiment of the present invention.

Referring now to FIG. 3, there is illustrated a block diagram of the apparatus for initiating operation of dishwasher 10, in accordance with a preferred embodiment of the present invention. As shown, a transmitter 51 is coupled to an oven (or stove or range) 50. Once oven 50 has been turned on, transmitter 51 transmits a signal to a receiver 52 that is coupled to control logic circuits 28 from FIG. 1) within dishwasher 10. The transmitted signal, which preferably includes a header field and an oven-on field, allows dishwasher 10 to "know" oven 50 has been turned on so that dishwasher 10 can begin its warm-up cycle (as shown in blocks 33, 34 of FIG. 2). Although a wireless connection is used to transmit signals from oven 50 to dishwasher 10, it is understood by those skilled in the art that a wire connection is also feasible for transmitting signals from oven 50 to dishwasher 10.

In addition, it is also possible to begin the warm-up cycle of dishwasher 10 upon the detection of other factors. For example, dishwasher 10 may begin its warm-up cycle upon the detection of oven 50 being turned off after oven 50 has been turned on for a predetermined amount of time, or dishwasher 10 may begin its warm-up cycle after a certain amount of time after the detection of oven 50 has been turned on, and such amount of time can be programmable by a user or can be adaptively learned by dishwasher 10 according to a user's normal behavior of using an oven in conjunction with a dishwasher. It is understood that the dishwasher can also be turned on manually by pressing a "warm-up function" button on the dishwasher.

As has been described, the present invention provides an improved residential dishwasher. Initiating a warm-up cycle in response to the turning on of a cooking apparatus, such as a stove, range, or oven, effectively reduces wait time for the initiation of the dishwashing process. The warming up of the washing chamber during the bathe cycle reduces the heat taken from the water in the subsequent wash cycle and allows the retained heat to be used for cleaning the dishes. The elevated temperature of the washing water over the prior art dishwashers allows a more intense cleaning and thus, a shorter and more effective wash cycle. As a result, the residential dishwasher of the present invention can complete the entire dishwashing process within approximately five to twelve minutes. Reducing the dishwashing process to less than twelve minutes has numerous benefits, such as the ability to rinse off tables and counters while the dishwasher is cleaning, and clean dishes are ready to be unloaded soon afterwards.

In addition, the usage of a water tank and a hot water heater that are internal to a dishwasher and the ability to deliver water to the washing chamber at a high temperature enable improved cleaning sanitation and the reduction of dishwashing times. Thus, washing/rinsing efficiency is greatly improved.

While the invention has been particularly shown and described with reference to a preferred embodiment, it will be understood by those skilled in the art that various changes in form and detail may be made therein without departing from the spirit and scope of the invention.

What is claimed is:

1. A method for controlling operations of a dishwasher, the method comprising the steps of:

in response to a cooking apparatus having been turned on, filling up a water tank within the dishwasher with water from a fresh water line;

heating the water in the water tank;

after dishes have been loaded in a washing chamber of the dishwasher, delivering heated water from the water tank into said washing chamber; and washing the dishes in the washing chamber with the heated water.

2. The method of claim 1, wherein the method further includes the steps of:

purging water from the washing chamber;

delivering additional heated water into the washing chamber from the water tank;

rinsing the dishes in the washing chamber; and purging rinse water from the washing chamber before unloading the dishes.

3. The method of claim 1, wherein the water from the fresh water line is in a range of approximately 120° F. to 140° F.

4. The method of claim 1, wherein the heating step further includes a step of heating water in the water tank to a range of approximately 190° F. to 210° F.

5. The method of claim 1, wherein the washing step further includes a step of washing the dishes with water entering the washing chamber at a temperature of at least 175° F.

6. The method of claim 1, wherein the washing step lasts for approximately two minutes.

7. The method of claim 2, wherein the rinsing step lasts for approximately two minutes.

8. The method of claim 1, wherein the method further includes a step of bathing the dishes in the washing chamber with hot tap water from a hot water line.

9. The method of claim 8, wherein the bathing step further includes a step of bathing the dishes with hot tap water in the range of approximately 120° F. to 140° F.

10. A method for controlling operations of a dishwasher, the method comprising the steps of:

heating water in a water tank within the dishwasher during a warm-up cycle;

after dishes have been loaded in a washing chamber of the dishwasher, washing dishes with hot water from a hot water tap during a bathe cycle;

delivering water from the water tank into the washing chamber; and washing and rinsing the dishes in the washing chamber with the delivered water during a wash/rinse cycle.

11. The method of claim 10, wherein the temperature of the hot water from a hot water tap is in the range of approximately 120° F. to 140° F.

12. The method of claim 11, wherein the temperature of the delivered water is at least 175° F.

13. A method for controlling operation of a first electrical appliance in the nature of a dishwasher requiring a warm-up cycle of substantial duration prior to an operating cycle the method comprising the steps of:

(A) initiating the required warm-up cycle of substantial duration of the first electrical appliance in the nature of a dishwasher in response to an initiating signal received by the first electrical appliance from a second electrical appliance in the nature of a cooking appliance disposed externally of the first electrical appliance; and (B) after completion of the warm-up cycle of substantial duration, initiating the operating cycle of the first electrical appliance.

* * * * *